US005697816A

United States Patent [19]

Wu

[11] Patent Number: 5,697,816

[45] Date of Patent: Dec. 16, 1997

[54] CABLE CONNECTOR

[75] Inventor: Kun-Tsan Wu, Tu-Chen, Taiwan

[73] Assignee: Hon Hai Precision Ind. Co., Ltd., Taiwan

[21] Appl. No.: 591,232

[22] Filed: Jan. 18, 1996

[51] Int. Cl.[6] ..... H01R 17/00

[52] U.S. Cl. ..... 439/660; 29/872; 439/354

[58] Field of Search ..... 439/660, 676, 439/295, 344, 874, 494, 499, 492; 29/860, 872, 873

[56] References Cited

U.S. PATENT DOCUMENTS 3,101,231 8/1963 Klostermann ..... 439/676

4,824,383 4/1989 Lemke ..... 439/108

5,098,319 3/1992 McGaffigan et al. ..... 439/874

*Primary Examiner*—Neil Abrams

*Assistant Examiner*—Christopher Goins

[57] ABSTRACT

A cable connector used to connecting between a portable communication device and an exterior charger apparatus . The cable connector has a number of contact arranged in a same plane but soldering positions of such contacts are located in different planes that are spaced apart by a larger distance. The contacts are divided into two groups of different contact structures disposed in the housing in an alternate arrangement so that the soldering portion of each contact has a larger space apart from that of the adjacent contacts, and the soldering process of contacts is convenient for manufacturer.

19 Claims, 8 Drawing Sheets

CABLE CONNECTOR

FIELD OF THE INVENTION

The present invention generally relates to the electrical connector for use with a portable communication device and in particular to a cable connector having a number of contacts arranged in a same row while their soldering locations are substantially disposed in different planes that are spaced apart a larger distance from each other for providing the manufacturer with convenience of soldering each contact of such cable connector to one corresponding conductor of a cable wire.

BACKGROUND OF THE INVENTION

Recently, the portable communication device, such as a cellular portable telephone, has been widely used in living and has even intended to be the necessity; however, portability and convenience of the portable communication device have caused that it is usually necessary to seek the power supply for re-supplying electricity when the electricity stored in the portable communication device is run out or not enough to use. Therefore, a conventional electrical connector as shown in FIG. 1, which was used to re-supply a portable telephone with electricity, has a front end portion of housing thereof to be inserted in a corresponding receiver body of the portable telephone and a rear end portion opposite to the front end portion of the housing joined to the cable wire having one twig connected with an exterior charger apparatus. The conventional electrical connector includes a number of contacts arranged in a same plane in a side-by-side arrangement with each other, and each contact has one end located in the front end portion for electrical contact with one of terminals in the receiver of the portable telephone and another one end soldered with one of corresponding conductors of the cable wire, whereby the conventional electrical connector can charge the portable telephone with electricity by electrically connecting to the exterior charger apparatus though the cable wire. Nevertheless, as the contacts of the conventional electrical connector are side by side closely arranged in the same plane of the housing, it is difficult and inconvenient for the manufacturer to solder respectively each one of conductors of the cable wire to each corresponding contact as shown in FIG. 1.

It is indicated clearly in FIG. 1 that each contact 10 of the conventional electrical connector having a soldering portion 101, which is used to joint with one of conductors 11 of the cable wire by soldering, is so small and the clearance between every two adjacent contacts 10 is so tiny that soldering the conductor to the corresponding contact is difficult and inconvenient for manufacturer, thus possibly resulting in insecure soldering and inaccurate joint thereof. Understandably, due to the high density requirement of contact arrangement of the connector, under the aforementioned situation, one contact may be electrically connected to the adjacent contact thereof via such inaccurate solder joint, and the shorting problem will be caused.

For solving the above problems of conventional electrical connector, a cable connector in accordance with the present invention is provided with two different contact structures arranged in an alternate or staggered arrangement for providing the manufacturer with convenience of accurately soldering each contact of the cable connector jointly to each corresponding conductor of a cable wire for stable and reliable connection.

SUMMARY OF THE INVENTION

According to one aspect of the present invention, a cable connector has a number of contacts arranged in a same row but the soldering positions of contacts are located in different planes that are spaced apart with a significant distance from each other. In the preferred embodiment, said contacts are divided into two different contact structures disposed in the housing in an alternate arrangement wherein a contact portion of each of the odd number contacts is coplanar with a soldering portion integrally horizontally rearward extending from the contact portion, and each of the even number contacts has a step portion integrally formed between the contact portion and the soldering portion so that the located level of the soldering portion each odd number contact is lower with a distance than that of its contact portion. Therefore, the location of contact portion of all contacts in the housing including odd number contacts and even number contacts, are coplanar with each other, while the soldering portion of each contact have an offset with that of the adjacent contact whereby the soldering process of the contacts is convenient for the manufacturer to avoid the problem of the conventional electrical connector that may be soldered to the other adjacent contact due to close arrangement thereof.

BRIEF DESCRIPTION OF THE DRAWINGS

The present invention will be better understood from the following description of an illustrative but non-eliminative preferred embodiment of the present invention, with reference to the attached drawings, wherein.

DETAIL DESCRIPTION OF AN EMBODIMENT OF THE INVENTION

Figure 1:
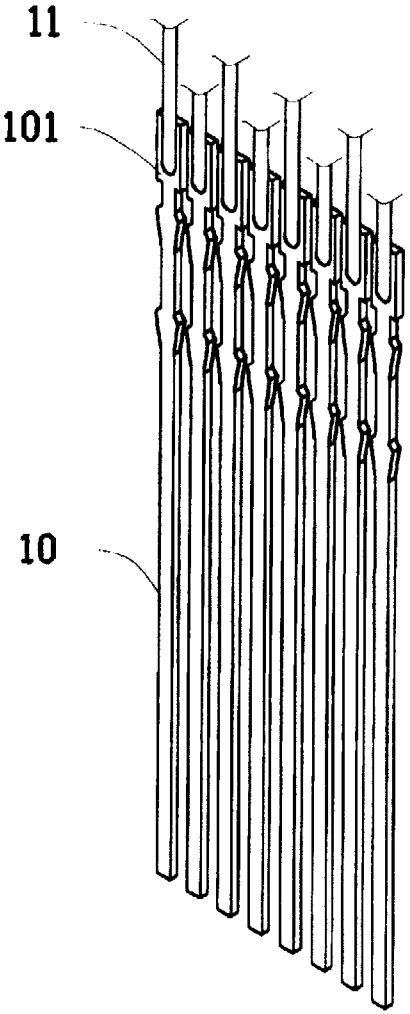
FIG. 1 is a perspective view of contacts of the conventional electrical connector wherein it shows that each contact is closely adjacent to each other and the soldering portions thereof are soldered with one corresponding conductor of a cable wire.
Figure 2:
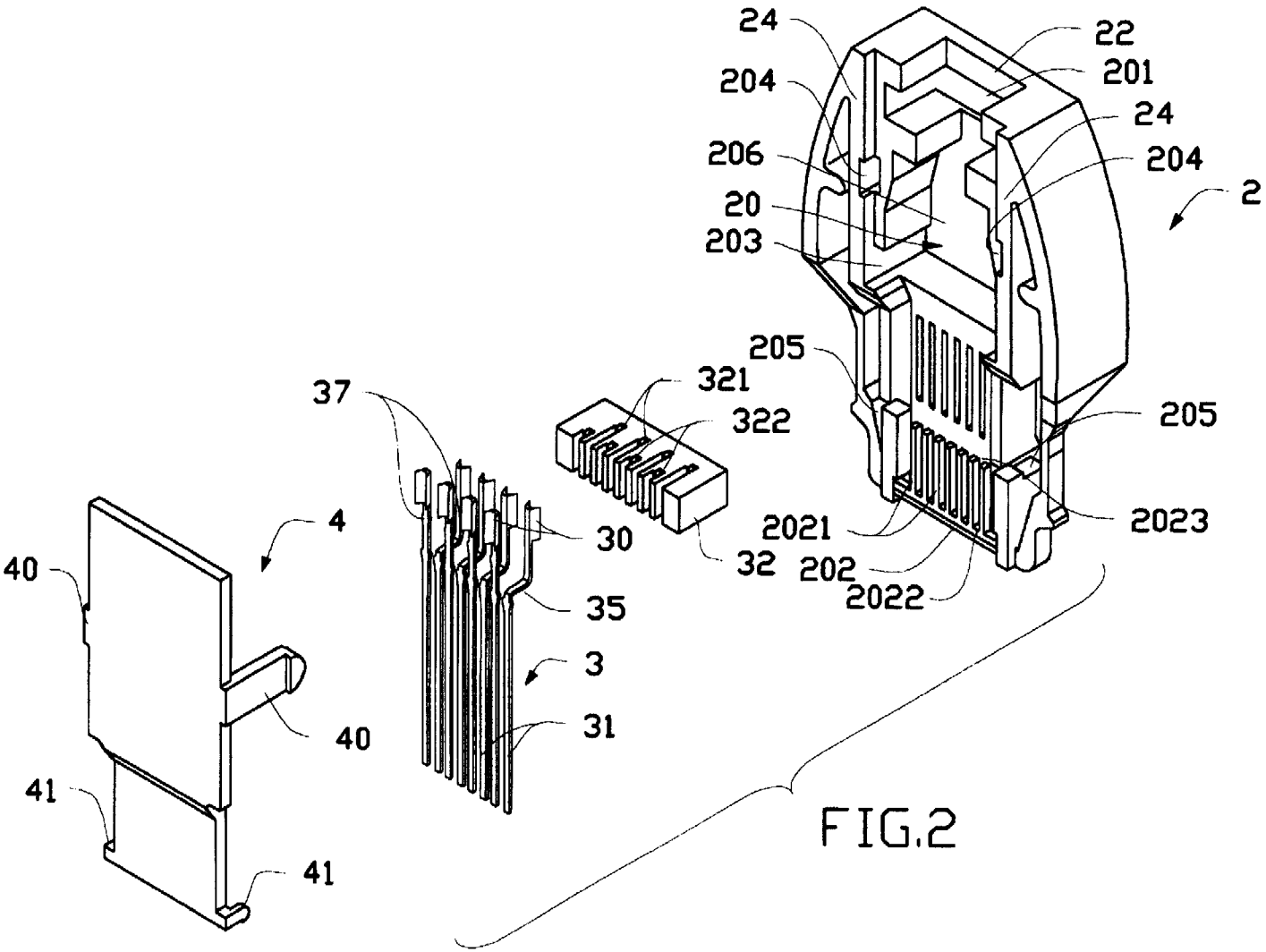
FIG. 2 is an exploded perspective view of a cable connector in accordance with the present invention.

Refer to FIG. 2 ,in accordance with the present invention , a cable connector 1 comprises an insulating housing 2, one row contacts 3 and an insulating cover 4. The insulating housing includes a base 22 and two side walls 24 integrally upward extending along two longitudinal edges of the base 22, and a flume 20 having an upward opening 206 formed by the base 22 and the two side walls 24. The front end of the insulating housing on the base 22 forms an inserted portion 202 wherein the top surface thereof is designed to have a plurality of juxtaposed ribs 2021 extending along the longitudinal direction of the base 22 and have a horizontal beam 2022 which is integrally connected with front end of each rib 2021 along the horizontal direction of the base. A recess 2023, that is defined between each two adjacent ribs 2021, retaining the two side edges of each contact 3 wherein each recess 2023 further extends through and underneath the horizontal beam 2022 for retaining the front end of each one contact 3 inlaid in the recess 2023. The rear end of the insulating housing 2 forms an opening portion 201 to receive a few conductors of a cable wire of which one twig is connected to an exterior charger apparatus (not shown). The flume 20 communicates with the opening portion 201 and the space located above the inserted portion 202.

The insulating housing 2 further comprises a hollow 203, that is approximately located in the center of the housing 2, for receiving an auxiliary block therein. A pair of top slots 204 are located respectively in the inward surfaces of top edges of two side walls 24 next to the hollow 203 and a pair of bottom slots 205 are located respectively in the outward surfaces of the two side walls 24 beside the center of the inserted portion 202 for providing the insulating cover 4 with retention.

Each of the contacts 3 includes a contact portion 31 having one end inserted in the recess 2023 and extending into the underside of the horizontal beam 2022 and having two side edges inlaid in the recess 2023 between each two adjacent ribs 2021 for upward contact with the corresponding one of terminals in a receiver of an exterior portable telephone (not show). A soldering portion 30 has a curve surface, which is located in the flume 20 for soldering with the corresponding one of conductors in a cable wire (not shown). A plurality of barbs 37 form on two side edges of the central portion of the contact 3.

The contacts 3 are divided into two different contact structures disposed in the housing 2 in an alternate arrangement wherein each of even number contacts 33 is defined that a contact portion 31 thereof is coplanar with a soldering portion 30 integrally horizontally rearward extending from the contact portion 31, and each of odd number contact 34 is defined that a step portion 35 is integrally formed between the contact portion 31 and the soldering portion 30 thereof so that the located level of the soldering portion 30 is lower by a distance than that of the contact portion 31, and moreover, the location of contact portion 31 of all contacts 3 in the housing 2 including even number contacts 33 and odd number contacts 34 are coplanar with each other, and that is to say the soldering portion 30 of each contact 3 has a significant space apart from that of the adjacent contact 3, whereby soldering each contact 3 is convenient for the manufacturer and it can be avoid to have solder joints applied to the adjacent contacts.

An insulating auxiliary block 32, that is installed in the hollow 203 of the housing 2, has a plurality of U-shaped slots that are designedly divided into the two different vertical depth slots 321, 322 formed in the top surface of the auxiliary block 32 in an alternate arrangement for receiving respectively each the corresponding contacts 3 including the even number contacts 33 and the odd number contacts 34. The U-shaped slots 321 having a longer depth are to each receive the step portion 35 of the odd number contact 34 with retention of the pair of barb 37 of the contact 34 provided therewith; the U-shaped slots 322 having a shorter depth are to each receive the center portion of the even number contact 33 with the retention of two pairs of barbs 37 of the contact 33 provided with. Therefore, the vertically staggered locations of the soldering portions of the contacts 3 are arranged and the convenience of soldering of contacts 3 to the corresponding conductors of the cable wire can be obtained.

The insulating cover 4, has a shorter longitudinal length than longitudinal the housing 2, and has two pairs of holders 40, 41 that are retained respectively in the pair of top slots 204 and in the pair of bottom slots 205 of the side walls 24 of the housing 2, and have the integral cover 4 fixed stably on the housing 2 for covering the flume 20 in the housing 2.

Figure 3:
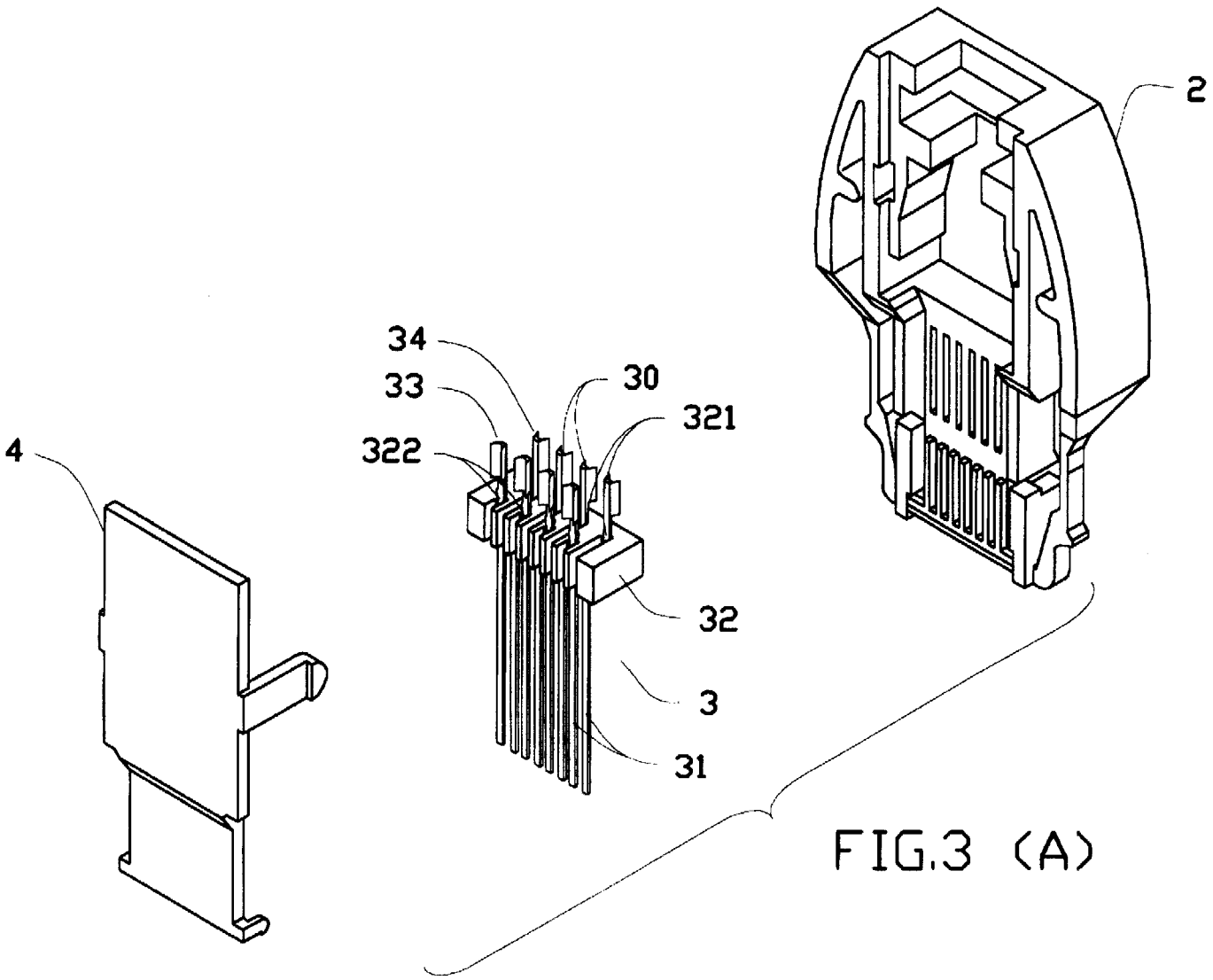
FIG. 3A, 3B and 3C show successively assembled views of the cable connector, wherein the connector include a plurality of contacts, an insulating auxiliary block and an insulating housing.
Figure 3:
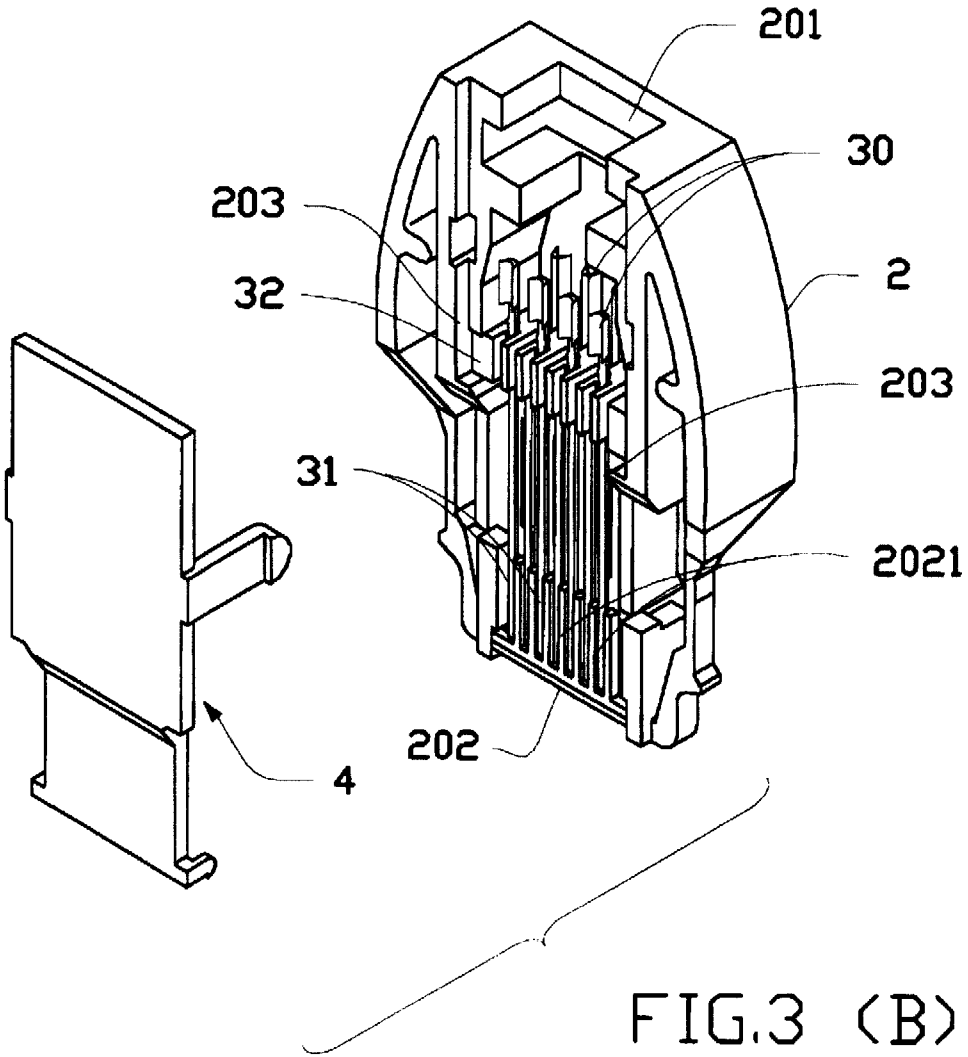
Figure 3:
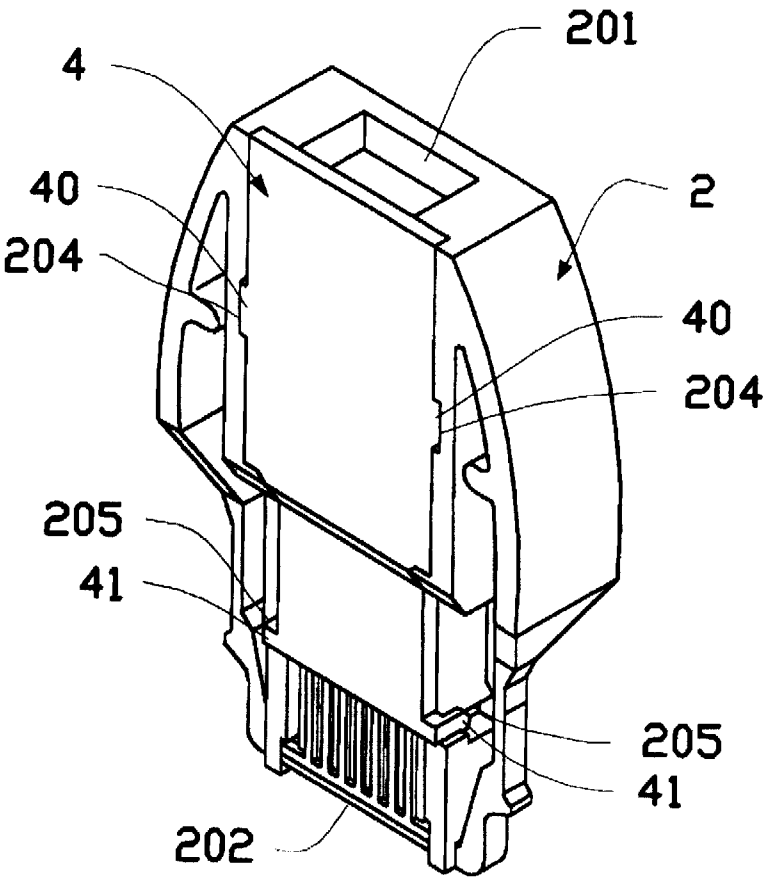

Further referring to FIGS. 3A, 3B and 3C concerning assembling of aforementioned all parts, wherein FIG. 3A shows that the step portion 35 of each odd number contact 34 is being retained in the corresponding U-shaped slot 321 having the longer depth in the auxiliary block 32 by a pair of barbs 37 of the contact 34, and the center portion of each even number contact 33 is retained in the corresponding U-shaped slot 321 having the shorter depth in the auxiliary block 32 by two pair of barbs 37 of the contact 33. FIG. 3B shows that the auxiliary block 32 accompanied with the row of contacts 3 is installed in the hollow 203 of the housing 2 and then the contact portion 31 of each contact 3 is inlaid in the recess 2023 between each two adjacent ribs 2021 of the housing 2 so that the horizontal movement of the contacts 3 can be restricted. Before installing the auxiliary block 32 into the hollow 203, first the soldering portion 30 of the contact 3 must be soldered with the corresponding conductors of a cable wire, and according to the design of the different structures of the contacts 33, 34 of the present invention that can enlarge the spaced distance between the soldering portion 30 of the contact 33 and the soldering portion 30 of the adjacent contact 34, the soldering process of the contacts 3 is fully convenient for the manufacturer. In the practice, the curve surface of the soldering portion 30 of the even number contact 33 is opposite to that of the odd number contact 34, so the auxiliary block 32 must be up-side-down turned for soldering the odd number contacts 34 after the soldering of the even number contacts 33 to the cable wire are completed. FIG. 3C shows that the cover 4 is fixed on the top surface of housing 2 by the retention of the holders 40, 41 of the cover 4 to the top slots 204 and the bottom slots 205 in the housing 2.

Figure 4:
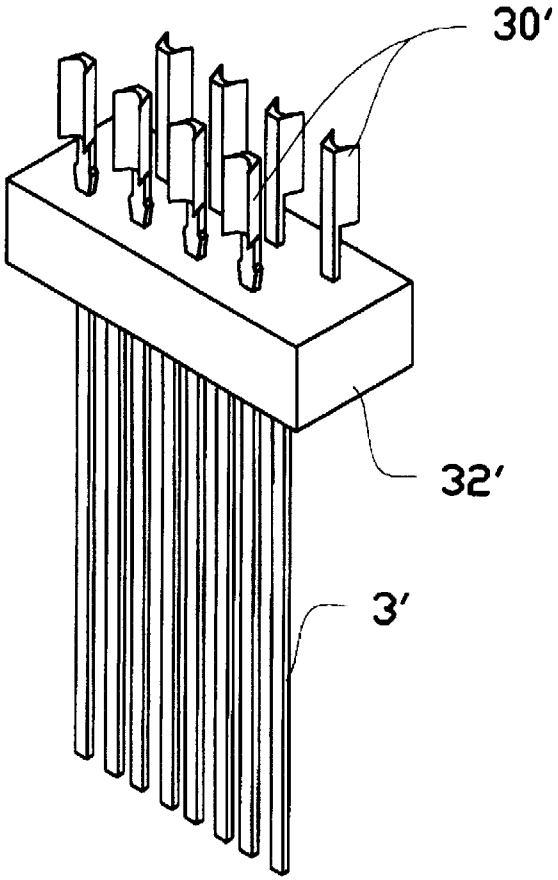
FIG. 4A shows a perspective view of the contacts connected, with carrier strips, of the cable connector of the second preferred embodiment in accordance with the present invention.
FIG. 4B shows a perspective view of the contacts in accordance with FIG. 4A embedded within an insulating auxiliary block by the insert-molding of the auxiliary block.
FIG. 4C shows an exploded view of the cable connector of the second preferred embodiment in accordance with the present invention.
Figure 4:
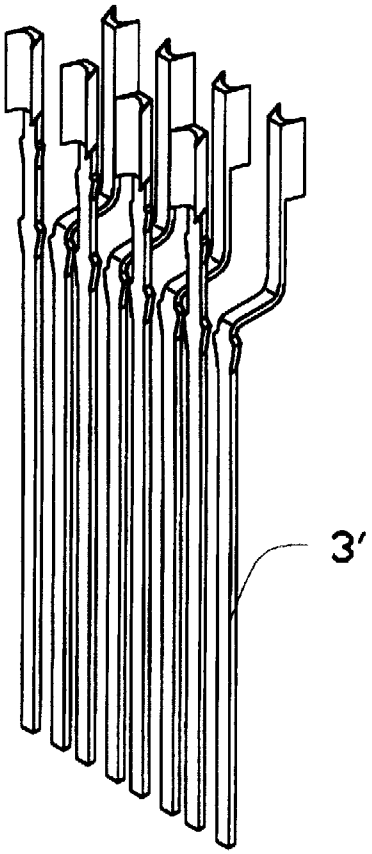
Figure 4:
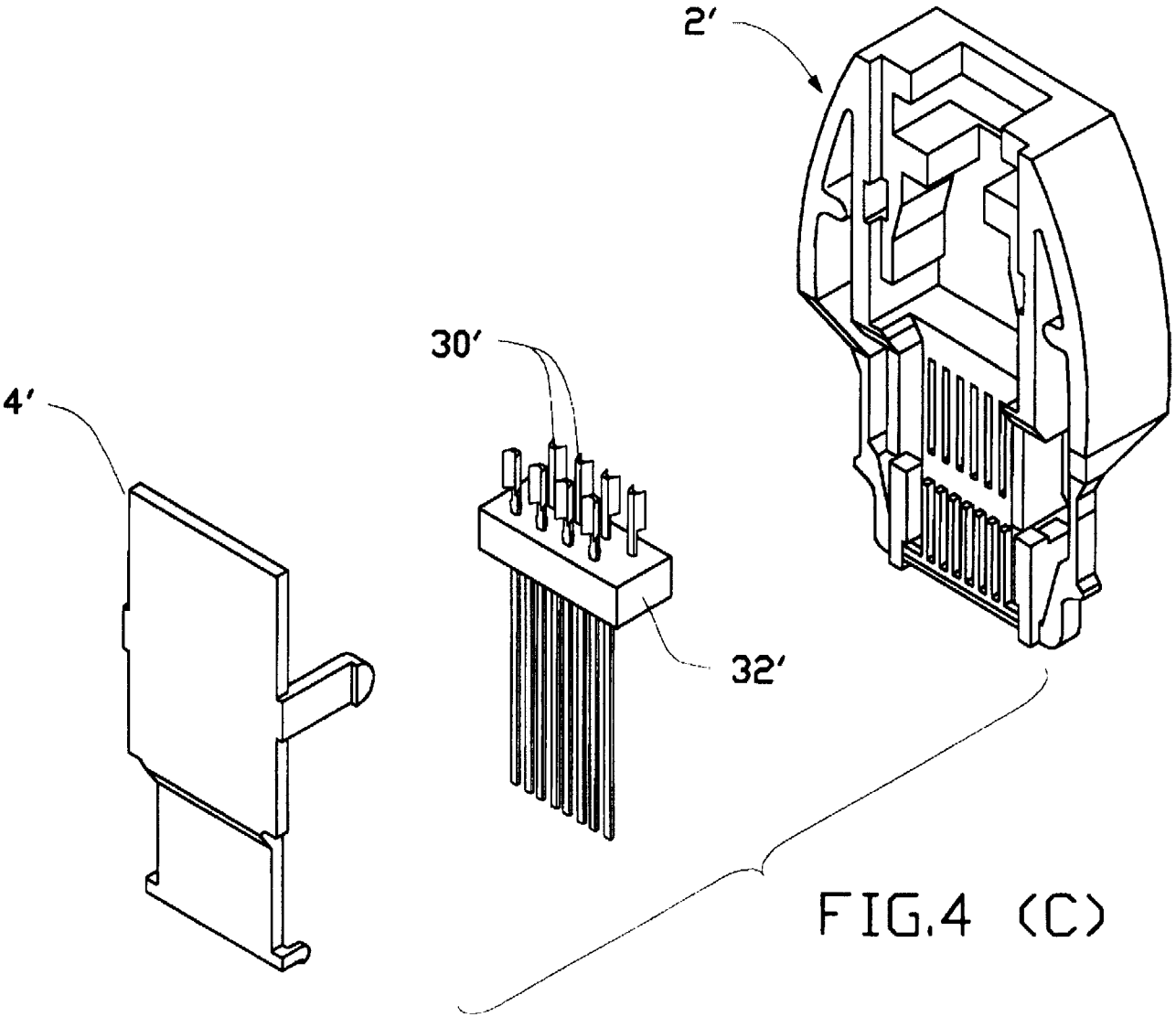
Figure 5:
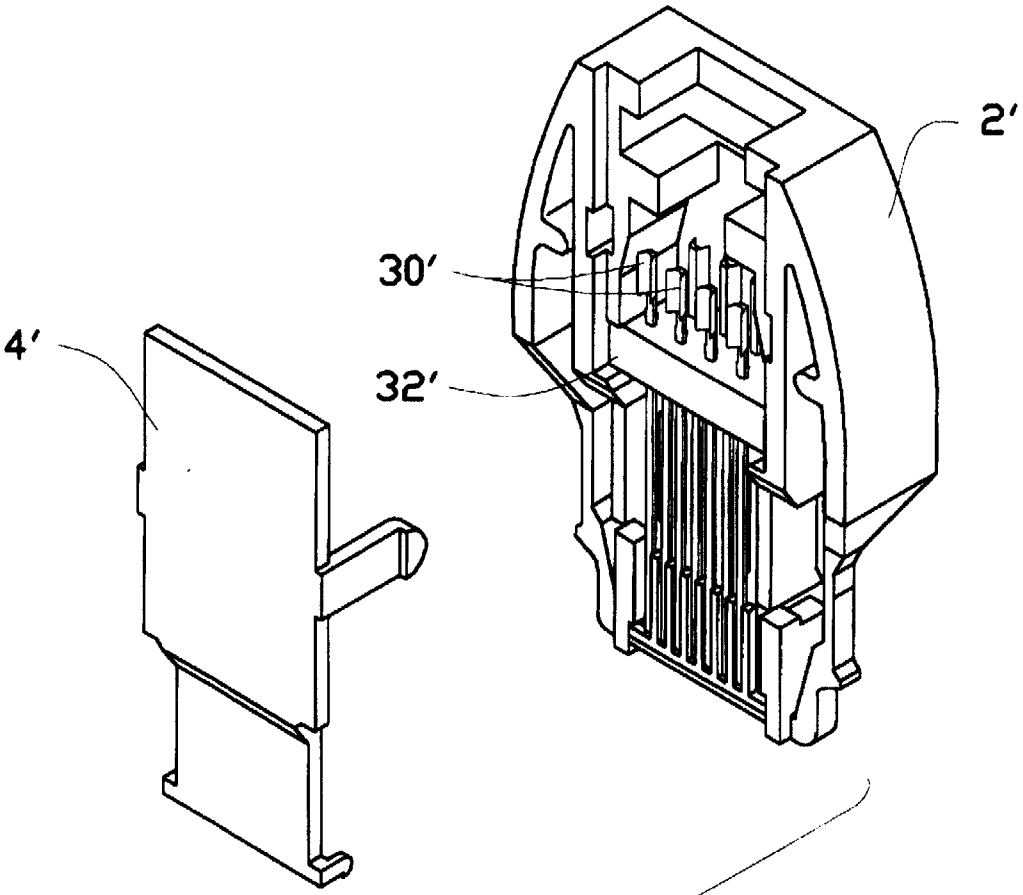
FIG. 5 show an assembled view in accordance with FIG. 4C.

Additionally, the second preferred embodiment in accordance with the present invention are shown in FIG. 4A, 4B and 4C. In FIG. 4A, it is indicated that the initial condition of the contacts 3' connected with carrier strips and the structure of contacts 3' is identical with the contacts 3 of the above-mentioned first embodiment. FIG. 4B show that the general center portion of the contacts 3' in accordance with FIG. 4A are integrally embedded within the auxiliary block 32' by the insert molding technology. FIG. 4C shows that the auxiliary block 32' accompanied with the contact 3' is installed in the hollow of the housing 2', and however, each contacts 3' must have been soldered with the corresponding conductors of a cable wire in practice before the auxiliary block 32' is installed in the housing 2'. The structure of housing 2' in detail is identical with the housing 2 of the first embodiment. FIG. 5 shows that the insulating cover 4' as the cover 4 of the first embodiment can cover the flume 20 and be retained in the housing 4, and therefore the second preferred embodiment in accordance with the present invention can satisfy identically the desire of the manufacturer.

It can be contemplated that arranging the soldering portions of the contacts in a vertically staggered manner not only provides a larger space thereabout for easy an accurate access during soldering process, but also allows such solder portions to be designed to have a larger or expanded dimension such as the curved surfaces thereof for firmly reliably soldering the corresponding conductors thereon. In the prior art, the soldering portions of the contacts can not expand laterally because they are so closely side by side arranged in the same plane.

It is apparent that although the invention has been described in connection with the preferred embodiments, it is contemplated that those skilled in the art may make changes to the preferred embodiments without departing from the scope of the invention as defined in the appended claims.

We claim:

1. An electrical connector comprising:

an insulating housing having a flume therein that includes an inserted portion and an opening portion for receiving a cable wire having a plurality of conductors thereof;

a plurality of contacts arranged in a same row in said flume, each of said contacts having at least a contact portion and a soldering portion; wherein said contact portion of each contact in the same row is inlayed in said inserted portion of the flume in a same plane with that of an adjacent contact, and the soldering portion of each contact in the same row is vertically spaced apart with a predetermined distance from that of the adjacent contact, whereby it is convenient to solder contacts to the corresponding conductors in the cable wire.

2. The electrical connector of claim 1 wherein an insulating cover is adapted to be retained in the housing for covering said flume.

3. The electrical connector of claim 1 wherein said flume is defined by one base and two side walls and the insulating housing includes a pair of top slots located respectively in the inward surfaces of two side walls of the housing and a pair of bottom slots located respectively in the outward surfaces of two side walls of the housing.

4. The electrical connector of claim 3 wherein the insulating cover includes two pairs of holders that are retained respectively in the pair of top slots and in the pair of bottom slots of the side walls of the housing for covering the flume in the housing.

5. The electrical connector of claim 1 wherein said inserted portion has a plurality juxtaposed ribs extending along a longitudinal direction of the base, a recess defined between every two adjacent ribs and a horizontal beam integrally connected with a front end of each rib along a horizontal direction of the base.

6. The electrical connector of claim 5 wherein said contact portion of each contact is inlayed in the corresponding recess for retention.

7. The electrical connector of claim 1 further includes an auxiliary block is provided for retaining stably the contacts in the flume of housing.

8. The electrical connector of claim 7 wherein said auxiliary block has at least one row of U-shaped slots for receiving each of the corresponding contacts therein.

9. The electrical connector of claim 1 wherein said contacts in the same row are divided into two groups of different contact structures in an alternate arrangement.

10. The electrical connector of claim 8 wherein said U-shaped slots arranged in the same row of auxiliary block include two different depths in an alternate arrangement in the auxiliary block for receiving the corresponding contacts, respectively.

11. The electrical connector of claim 1, wherein the soldering portion of each contact has an expanded curved surface thereof.

12. A cable connector comprising:

an insulating housing having a flume therein, one end of said flume integrally forming an inserted portion for use with an electrical device having a plurality of terminals, and another end of said flume forming an opening portion for receiving a cable wire having a plurality of conductors thereof;

a plurality of contacts arranged in a same row in said flume in an alternate arrangement and each of said contacts including a contact portion inlayed in said inserted portion of the housing in a same plane for contact with the terminals of said electrical device, and a soldering portion adapted to be soldered with the conductors of said cable wire wherein the soldering portion of each of said contact in the same row is spaced apart by a predetermined distance with the soldering portion of the adjacent contacts in the same row for easy access during soldering; and an auxiliary block adapted to retain stably the contacts in the flume of housing.

13. The cable connector of claim 12 wherein an insulating cover is attached to and retained in the housing for covering said flume.

14. An arrangement of plural contacts arranged in a same row within an electrical connector, each of said contacts including a contact portion and a soldering portion wherein all of the contact portions of the contacts are substantially positioned in a same plane but the soldering portions of the contacts are designed in a staggered manner vertically so that there is a significantly large space in a vertical direction between the soldering portions of every two adjacent contacts in the same row for easy and accurately soldering to corresponding conductors of a cable wire which is attached to the connector.

15. The arrangement of claim 14 wherein the soldering portions of said contacts are designedly at least positioned in two levels.

16. A method of assembling an electrical connector, wherein said connector includes an insulating housing to which a cable wire having a plurality of conductors is attached, and a corresponding number of contacts receiveably arranged in a same row within the housing each of which has a contact portion for engagement with a terminal and a soldering portion for solderable engagement with said conductor, the soldering portions of every two adjacent contacts in the same row being staggered with each other in a vertical direction and have the soldering surfaces, and the steps at least comprising:

soldering the soldering portions of some of the contacts, which have soldering surfaces facing a first direction away from the insulating housing, to the corresponding conductors;

soldering the soldering portions of the rest of the contacts, which have soldering surfaces facing a second direction opposite to the first direction, to the corresponding rest of the conductors; and retaining said contacts and said conductors in the housing.

17. The method of claim 16, wherein an auxiliary block is provided for retaining the soldering portions of the contacts before soldering.

18. The method of claim 16, wherein a cover is provided to cover the contacts after said contacts and conductors have been installed within the housing.

19. An electrical connector comprising:

an insulating housing having a flume therein that includes an inserted portion and an opening portion for receiving a cable wire having a plurality of conductors thereof;

a plurality of contacts arranged in a same row in said flume, each of said contacts having at least a contact portion and a soldering portion; wherein said contact portion of each contact is inlayed in said inserted portion of the flume in a same plane with that of an adjacent contact, and the soldering portion of each contact arranged is vertically spaced apart with a predetermined distance from that of the adjacent contact in the same row, whereby it is convenient to solder contacts to the corresponding conductors in the cable wire, and an auxiliary block having a plurality of U-shaped slots arranged in a same row wherein said U-shaped slots comprising two different depths thereof in an alternate arrangement for receiving the corresponding contacts, respectively.

* * * * *